US007852299B2

(12) United States Patent
Kawasaki et al.

(10) Patent No.: US 7,852,299 B2
(45) Date of Patent: Dec. 14, 2010

(54) ACTIVE-MATRIX DEVICE

(75) Inventors: Somei Kawasaki, Saitama (JP); Tatsuhito Goden, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 936 days.

(21) Appl. No.: 11/689,836

(22) Filed: Mar. 22, 2007

(65) Prior Publication Data

US 2007/0229412 A1 Oct. 4, 2007

(30) Foreign Application Priority Data

Mar. 31, 2006 (JP) ..... 2006-097996

(51) Int. Cl.
*G09G 3/32* (2006.01)

(52) U.S. Cl. ..... 345/82

(58) Field of Classification Search ..... 345/76–77, 345/82, 204

See application file for complete search history.

(56) References Cited

U.S. PATENT DOCUMENTS 6,509,690 B2 1/2003 Sempel et al. ..... 315/169.3
7,046,220 B2 * 5/2006 Tagawa et al. ..... 345/76
7,126,565 B2 * 10/2006 Kawasaki et al. ..... 345/76
7,319,443 B2 * 1/2008 Kimura et al. ..... 345/76
7,477,218 B2 * 1/2009 Koga et al. ..... 345/80
2005/0285151 A1 * 12/2005 Kawasaki ..... 257/213
2007/0097037 A1 5/2007 Yamashita et al. ..... 345/76

FOREIGN PATENT DOCUMENTS

JP 2004-151166 5/2004
JP 2004-325940 11/2004

* cited by examiner

*Primary Examiner*—Chanh Nguyen
*Assistant Examiner*—Tsegaye Seyoum
(74) *Attorney, Agent, or Firm*—Fitzpatrick, Cella, Harper & Scinto

(57) ABSTRACT

A display device includes a driving transistor for supplying driving current to a display element; a first switch connecting the driving transistor to a corresponding data line; a second switch selectively connecting a control electrode of the driving transistor to one of two main electrodes of the driving transistor; and a third switch connecting the driving transistor to the display element in one pixel. The first switch is controlled by a first control line. The second and third switches each include two switching elements connected in series controlled by the first control line and a second control line, respectively. Four functions of writing of data in the pixel, light emission of the display element by supplying current, non-light emission of the display element, and examination of the pixel operation can be switched using the two control lines.

9 Claims, 8 Drawing Sheets

ACTIVE-MATRIX DEVICE

BACKGROUND OF THE INVENTION

1. Field of the Invention

The present invention relates to active-matrix devices included in display apparatuses, electron-emitting apparatuses, light-emitting apparatuses, and the like.

2. Description of the Related Art

Active-matrix display devices having a matrix of pixels, each pixel including a display element and a driving circuit, often are used in liquid-crystal display apparatuses, electroluminescent (EL) display apparatuses, and the like.

The driving circuits (also referred to as "pixel circuits") provided for the pixels of the active-matrix display devices have a function of retaining currents or voltages supplied via signal lines according to display signals and a function of supplying the currents or the voltages to the display elements. Pixel circuits in an EL display apparatus disclosed in Japanese Patent Laid-Open No. 2004-151166 have a function of examining the individual operations thereof by detecting values of currents passing through driving thin-film transistors (TFTs) thereof in addition to functions of setting driving currents and supplying the driving currents to EL elements. These three functions are switched using two control lines disposed in a transverse direction.

Pixel circuits in an organic EL display apparatus disclosed in U.S. Pat. No. 6,509,690 have a function of controlling emission time of EL elements using switches that block current paths connected to the EL elements in addition to a function of acquiring and retaining display signals and a function of supplying voltages or currents corresponding to the display signals to the EL elements. These functions can also be switched using two control lines. Japanese Patent Laid-Open No. 2004-325940 also discloses EL driving circuits capable of controlling the emission time.

The above-described pixel circuits have three of the four functions of acquiring and retaining signals, supplying currents or voltages corresponding to the signals to display elements, examining the operations of the pixel circuits, and controlling emission time of the display elements. All these four functions are required for the pixel circuits since all of them are important functions for display apparatuses and are important as testing techniques during the manufacturing process.

On the other hand, the number of control lines used for switching the functions needs to be minimized. In general, the number of pixels of display apparatuses needs to be increased to provide higher definition, and in particular, an increase in the number of rows of small display apparatuses is required. To this end, the areas of pixels need to be reduced, and in addition, the number of control lines needs to be minimized. Since pixel circuits include circuit components such as TFTs and capacitors and wiring lines connecting these circuit components disposed on a substrate, the areas of the pixel circuits are mostly determined according to circuit design rules. The control lines are wiring lines extending in the transverse direction in each row for selecting rows and switching functions of the pixel circuits in the rows. The control lines extend uninterruptedly regardless of difference in level, and have a certain limited width for reducing the resistance to a predetermined level. An increase in the number of control lines can lead to an increase in the pitch of the pixels, and can be unsuitable for high-definition display apparatuses.

SUMMARY OF THE INVENTION

The present invention is directed to a display device including a matrix that includes a plurality of rows and columns of pixels, each pixel including a display element and a driving circuit arranged to drive the display element; a plurality of pairs of control lines, each pair being associated with at least one corresponding row of the pixels and including a first control line and a second control line; and a plurality of data lines, each data line being associated with at least one corresponding column of the pixels. The driving circuit of each pixel includes a driving transistor including at least first and second main electrodes and a control electrode, at least one first switch operable to switchably connect a corresponding one of the data lines to the first main electrode of the driving transistor, at least one second switch operable to switchably connect the first main electrode of the driving transistor to the control electrode of the driving transistor, and at least one third switch operable to switchably connect the first main electrode of the driving transistor to the display element of the driving circuit. The first and second control lines associated with the row of the pixel are arranged to control the switches such that the at least one first switch and at least part of the at least one second switch are opened or closed at the same time, and such that at least part of the at least one second switch and at least part of the at least one third switch are opened or closed at the same time.

According to one aspect of the present invention, the switches can be controlled by using two control lines, and four functions of acquiring and retaining display signals, supplying voltages or currents corresponding to the display signals to display elements, examining the operations of pixel circuits, and controlling emission time of the display elements can be switched using the two control lines. With this, the number of control lines for switching the functions can be regulated to two, and thus display devices with higher definition can be realized. Moreover, since only two control lines are required, only small parasitic capacitances are generated at intersecting portions between the data lines and the control lines.

Further features of the present invention will become apparent from the following description of exemplary embodiments with reference to the attached drawings.

DESCRIPTION OF THE EMBODIMENTS

First Exemplary Embodiment

Active-Matrix Display Device

First, an active-matrix display device including light-emitting elements serving as display elements will be described with reference to FIGS. 1A to 2. The light-emitting elements emit light using electroluminescence.

Figure 1A:
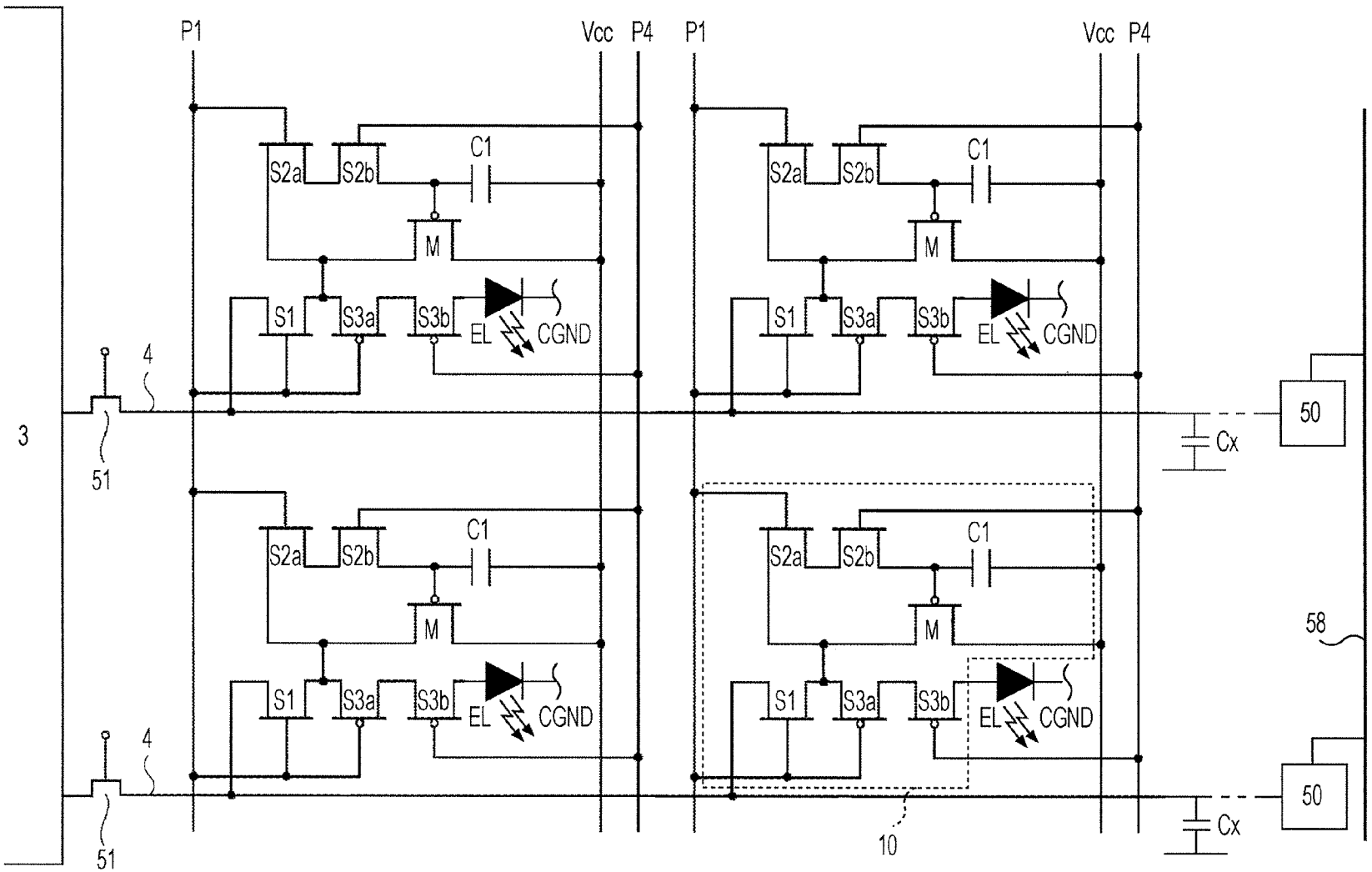
FIG. 1A illustrates pixel circuits and circuits in the vicinity thereof in a display device according to an exemplary embodiment of the present invention.
Figure 1B:
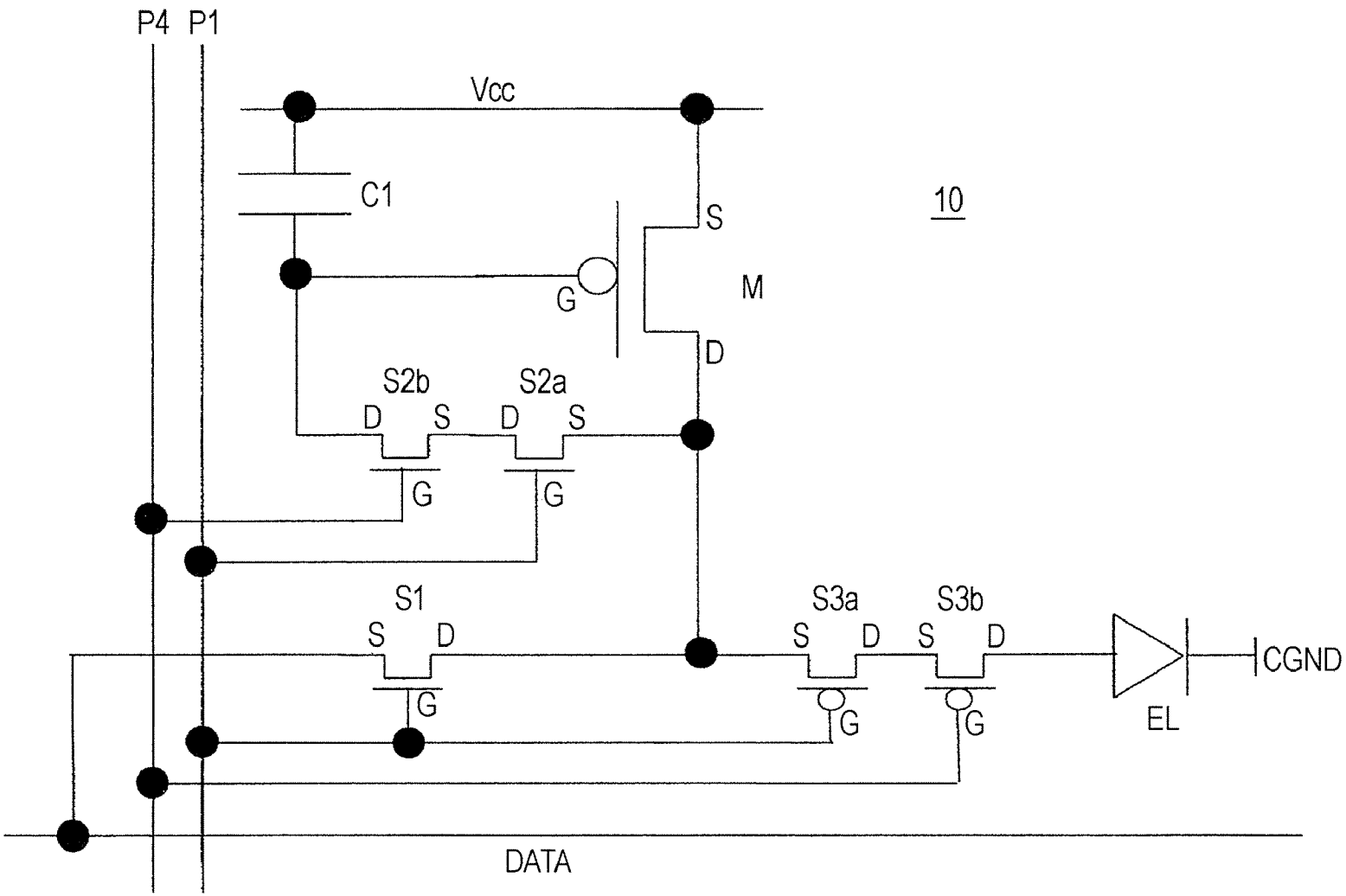
FIG. 1B illustrates one of the pixel circuits.
Figure 2:
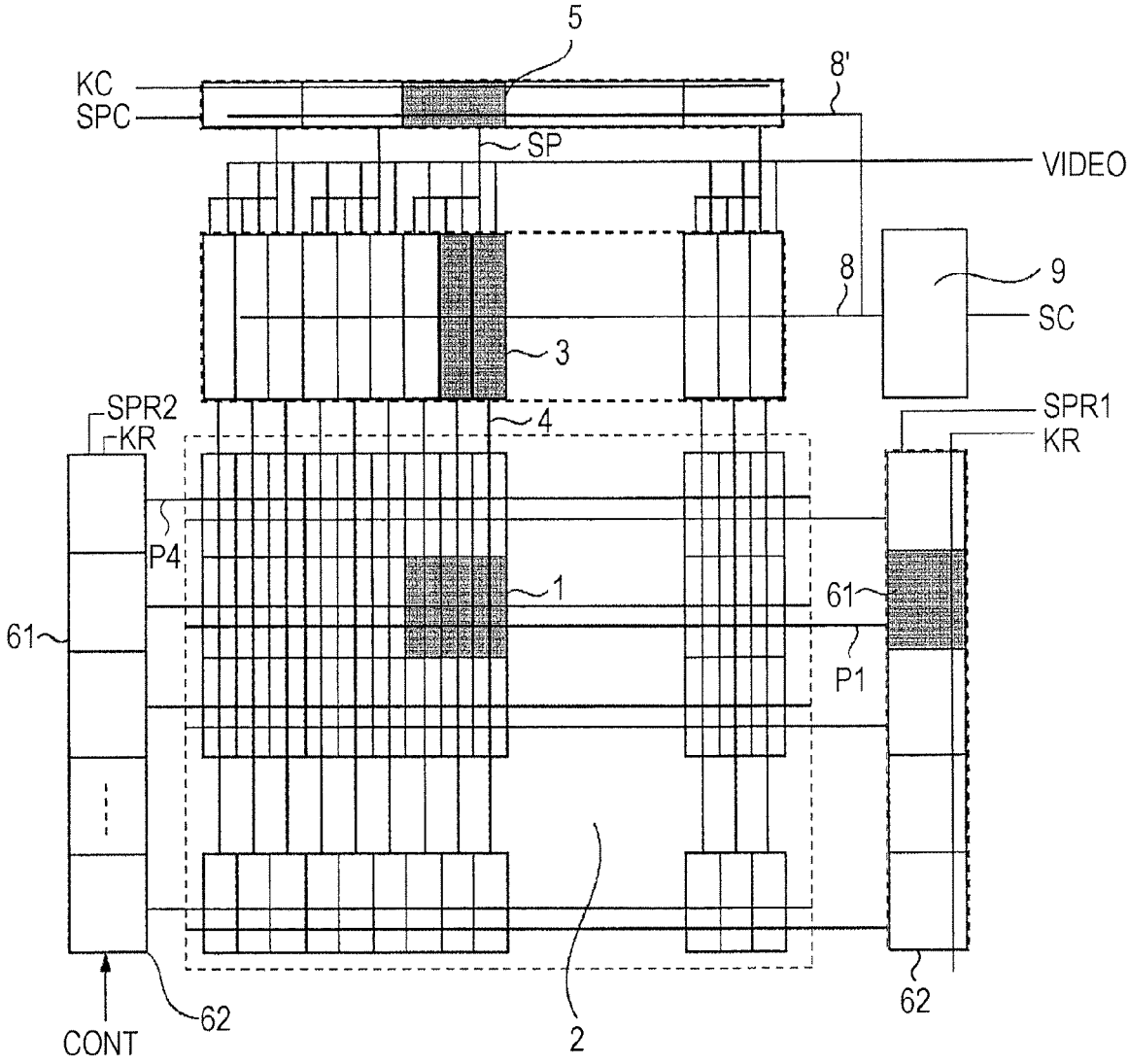
FIG. 2 is a block diagram illustrating the entire structure of the display device according to the exemplary embodiment of the present invention.

FIG. 2 illustrates the structure of the active-matrix display device, according to an exemplary embodiment of the invention, and FIG. 1A illustrates pixel circuits 10 of an active-matrix display device such as that shown in FIG. 2. In FIG. 2, a matrix of pixels 1 is disposed in a display area 2, each pixel including a light-emitting element EL and a pixel circuit 10 (FIG. 1B)(disposed at the same position as the corresponding pixel 1 in FIG. 2) that drives the light-emitting element EL. Data-signal lines (hereinafter referred to as data lines) 4 extend in a longitudinal direction (in the top-to-bottom direction in the drawing) and pairs of first and second control-signal lines (hereinafter referred to as control lines) P1 and P4 extend in the transverse direction (in the left-to-right direction in the drawing) in the display area 2 so as to be connected to the pixel circuits 10. A respective pair of control lines P1 and P4 is disposed in each row, and respective ones of the data lines 4 are disposed in respective ones of the columns. The control lines P1 and P4 function as scanning lines, and the pixel circuits 10 in one row are selected using a row-selection signal supplied via the corresponding pair of the control lines P1 and P4. Data signals are supplied to the pixel circuits 10 in the selected row via the data lines 4. When the row becomes deselected, driving currents corresponding to the data signals are applied from the pixel circuits 10 to the light-emitting elements EL such that the light-emitting elements EL emit light at brightness levels according to the driving currents. The light-emitting elements in the pixels are laminated on the corresponding pixel circuits so as to form a two-dimensional matrix in the display area 2. The light-emitting elements can be arranged in a so-called stripe pattern having function elements arranged in lines, in a so-called delta pattern in which positions of pixels in adjacent rows are shifted by half the length of the pixels, or the like.

To produce color images, groups of three pixel circuits 10 having display elements of RGB can be used.

The control lines P1 and P4 receive signals from corresponding row-controlling circuits 62 disposed at one or both sides of the display area 2. The row-controlling circuits 62 include row registers 61 each having a register block, wherein the number of row registers 61 corresponds to the number of rows, and receive row clocks KR and start-of-row-scanning signals SPR1 and SPR2, respectively. The row-controlling circuit 62 disposed at the left side of the display area in FIG. 2 and supplying signals to the control lines P4 receives control signals CONT for adjusting the brightness of the entire screen.

The data signals supplied to the data lines 4 are generated at column-driving circuits 3. In a preferred embodiment of the invention, three column-driving circuits 3 are grouped into one so as to correspond to the display elements of RGB that are arranged on every three columns. Each of the column-driving circuits 3 receives image signals VIDEO and sampling signals SP so as to generate the data signals for data lines 4. The data signals are supplied to the data lines 4 according to the supply timing of horizontal control signals on line 8. A control circuit 9 generates the horizontal control signals on line 8 in response to the input of horizontal synchronization signals SC. Column registers 5 also are reset in response to the input of the horizontal control signals on line 8', and successively generate the sampling signals SP using column clocks KC and start-of-sampling signals SPC.

Pixel Circuit

FIG. 1A illustrates four of the pixel circuits 10 (one of them being enclosed with a dotted line) and circuits in the vicinity thereof in the active-matrix display device according to an exemplary embodiment of the present invention.

The pixel circuits 10 each include one EL light-emitting element EL (or EL element EL), and one end of the EL element EL is connected to a common electrode CGND serving as a reference voltage source. Herein, as an example, the potential of the common electrode CGND corresponds to the ground level. Data lines 4 for transmitting display signals extend in a longitudinal direction (in the left-to-right direction in FIG. 1A). Capacitors C1 receive display data from the data lines 4, and retain electrical charges corresponding to the data. Driving transistors M supply driving currents to the EL elements EL. Transistor sources, each of which is one of two main electrodes of each transistor, are connected to a reference voltage source Vcc, and the drains, each of which is the other one of the two main electrodes of each transistor, are selectively connected to the corresponding data lines 4 via selection switches (first switches) S1. The operations of the first switches S1 are controlled by the corresponding first control lines P1. The gates, which are control electrodes of the driving transistors M, are connected to the reference voltage source Vcc via the corresponding capacitors C1.

The drains of the driving transistors M are also connected to the gates of the same driving transistors M via second switches S2, which include switching transistors S2*a* and S2*b*. The second switches S2 are circuits each including switching transistor S2*a* and switching transistor S2*b* connected in series, the switching transistors S2*a* and S2*b* being controlled by the corresponding first control line P1 and the corresponding second control line P4, respectively. When the second switches S2 are turned on, the drains and gates of the individual driving transistors M are connected to each other.

Furthermore, the drains of the driving transistors M are connected to the corresponding light-emitting elements EL via third switches S3, which include switching transistors S3*a* and S3*b*. The third switches S3 are circuits each including switching transistor S3*a* and switching transistor S3*b* connected in series, the switching transistors S3*a* and S3*b* being controlled by the corresponding first control line P1 and the corresponding second control line P4, respectively.

The switches S1 to S3 controlled by the control lines P1 and P4 switch functions of the pixel circuits 10, and at the same time, have a role as row-selecting lines, i.e., scanning lines, used for selecting the pixel circuits 10 in one row. That is, the functions of the pixel circuits 10 in one row are selected by turning on or off the switches S1 to S3, and then the next, the switches S1 to S3 in another row are turned on or off. In this manner, the function selection is successively performed sequentially on a row-by-row basis.

Figure 3:
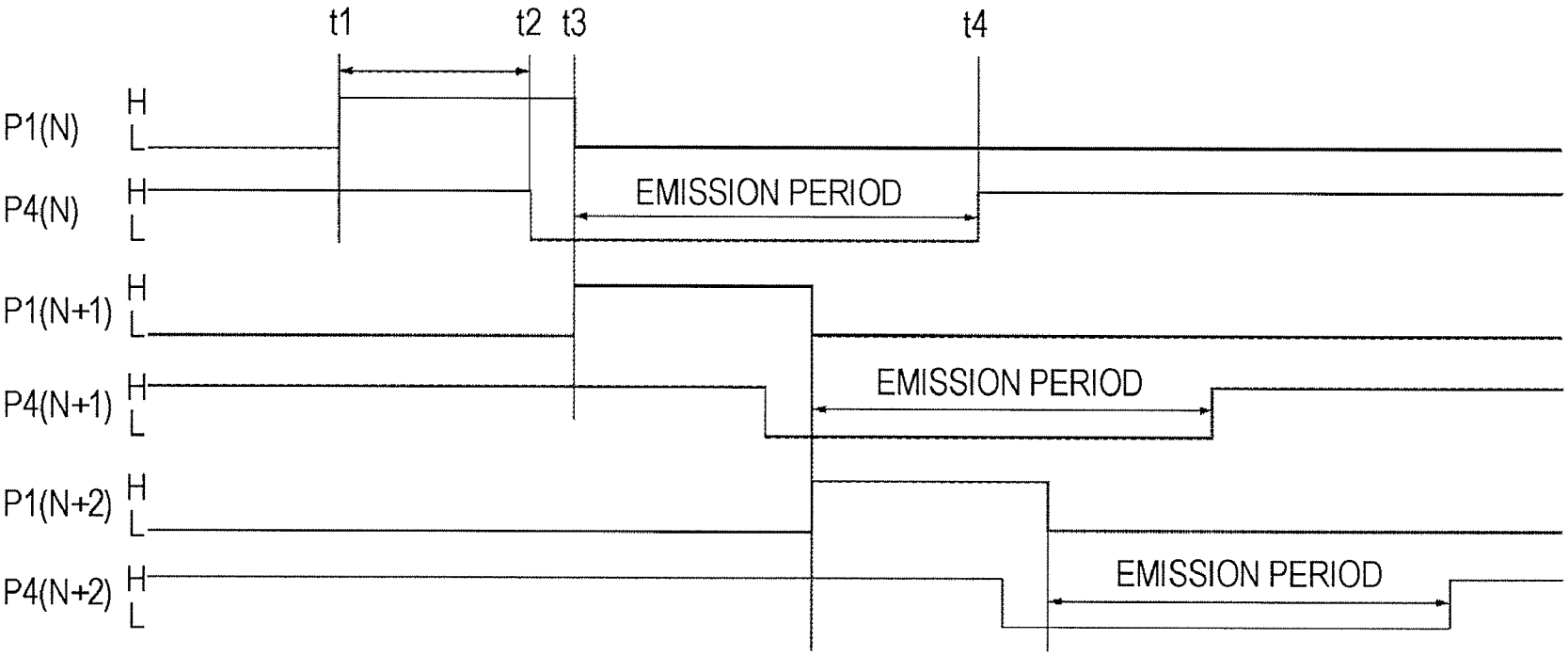
FIG. 3 is a timing chart illustrating the operations of the pixel circuits shown in FIG. 1A.

FIG. 3 is a timing chart illustrating the operations of the pixel circuits 10 shown in FIG. 1A. The operations of the pixel circuits 10 in one row (herein the Nth row) will be described. The control lines P1 and P4 provided for each row are expressed as P1(N), P4(N), and the like so as to distinguish the rows to which the control lines P1 and P4 belong, where N is the row number. At time t1, the voltage of the first control line P1(N) is raised from a low (L) level to a high (H) level while the voltage of the second control line P4(N) is maintained at the H level. With this, the first switches S1 and the switching transistors S2*a* and S2*b* are turned on, and the switching transistors S3*a* and S3*b* are turned off. As a result, data-signal currents supplied to the data lines 4 pass between the sources and the drains of the driving transistors M, and voltages corresponding to the currents are generated at the capacitors C1.

At time t2, the voltage of the second control line P4(N) is lowered from the H level to the L level. This turns off the switching transistors S2*b*, and the connections between the gates and the drains of the driving transistors M are cut off. As a result, the data-signal currents are converted into voltages, and retained at the level by the charges stored in the capacitors C1. In this manner, the driving transistors M become ready to supply currents (driving currents) corresponding to the data-signal currents. These operations of acquiring the display data from the data lines and of retaining the data are referred to as "current programming". The switching transistors S3*b* are turned on for a period between the time t2 and time t3. However, the driving currents are not supplied to the light-emitting elements EL since the switching transistors S3*a* are maintained in a turned off state.

At the time t3, the voltage of the first control line P1(N) is lowered from the H level to the L level. With this, the switching transistors S2*a* are turned off, and the switching transistors S3*a* are turned on. As a result, the driving currents are supplied from the driving transistors M to the light-emitting elements EL. This drives the light-emitting elements EL to emit light at brightness levels according to the currents.

At the time t3, the voltage of the first control line P1(N+1) in the next row is raised from the L level to the H level, and the pixel circuits in the (N+1)th row start the current programming operation.

At time t4, after a desired emission time has elapsed since the light-emitting elements EL in the Nth row start emitting at the time t3, the voltage of the second control line P4(N) is raised from the L level to the H level. As a result, the switching transistors S3*b* are turned off, and the current supply from the driving transistors M to the light-emitting elements EL is stopped. With this, the light-emitting elements EL are switched to a non-light emission state. Thus, the light-emitting elements EL of the Nth row emit light and the pixels including the light-emitting elements EL illuminate for a period between the time t3 and the time t4, but such light emission terminates at time t4.

In this manner, acquisition of the current signals (programming), light emission (supply of driving currents), and non-light emission (cutoff of the driving currents) are repeated in the order of rows in a chronological manner, at times indicated in FIG. 3, for example.

The periods for which the voltages of the second control lines P4 are set to the L level are the same in terms of rows such that the emission period in each row is constant. The brightness of the EL elements EL is controlled using the emission period and the currents passing during the period. The length of the emission period is given by the external control signals (CONT shown in FIG. 2). Data that determines the length of the emission period given by the control signals CONT is retained in registers (not shown) in the row-controlling circuits 62. With reference to the data, the row-controlling circuits 62 determine generation timings of signals supplied to the second control lines P4.

As shown in FIG. 2, the row-selection signals supplied to the first control lines P1 and the row-selection signals supplied to the second control lines P4 are generated at the pairs of the opposing row registers 61 that are disposed at either side of the display area. As described above, the first control lines P1 switch between the two states of display data acquisition and light emission, and the second control lines P4 switch between the two states of light emission and non-light emission, aside from a current-testing function of the pixel circuits (described below). The switching between the light emission and the non-light emission using the second control lines P4 extending in the transverse direction allows the control of the brightness of the entire display screen independently of the gray-scale control using the data signals supplied via the data lines 4. The control signals CONT shown in FIG. 2 adjust the brightness of the entire display screen.

In the case of a display apparatus capable of providing a 256-step gray scale, 256-step data currents are supplied to the data lines. On the other hand, the brightness of the entire screen is determined according to the control signals CONT independent of the video signals. The brightness of the display screen can be controlled by changing the time t3 (light emission timing) and the time t4 (non-light emission timing) at which the levels of the row-selection signals supplied to the control lines P1 and P4, respectively, are switched according to the control signals CONT for specifying the brightness.

Ideally, the period between the time t2 and the time t3 is omitted. However, this period can reliably prevent the connection of the gates and the drains of the driving transistors M and the light-emitting elements EL caused when the switching transistors S2*a*, S2*b*, S3*a*, and S3*b* are turned on at the same time. With this, the programming voltages can be reliably retained at the levels corresponding to the data signals by the charges stored in the gate capacitors C1.

Current Testing Operation

Next, circuits for current testing and operations thereof will be described.

Current-detecting circuits 50 shown in FIG. 1A output currents or voltages according to the amplitudes of the currents passing through the data lines 4 or the voltages of the data lines 4. In FIG. 1A, the current-detecting circuits 50 are disposed at ends of the data lines 4. However, the current-detecting circuits 50 can be disposed at any downstream positions of switches 51 on the data lines 4 (for example, between the column-driving circuits 3 and the display area 2 of FIG. 2). The data lines 4 are connected to the column-driving circuits 3 via the switches 51. The switches 51 can be integrated into the column-driving circuits 3 (FIG. 1A). When the outputs of the column-driving circuits 3 correspond to drain terminals of TFTs serving as switching elements, the output impedance can be set to a high value by turning the TFTs off. This operation corresponds to the function of the switches 51, and none of the switches 51 are required outside the column-driving circuits 3, although for convenience they are depicted that way in FIG. 1A. In other embodiments, switches S1 can be external to the circuit(s) 3.

Figure 4:
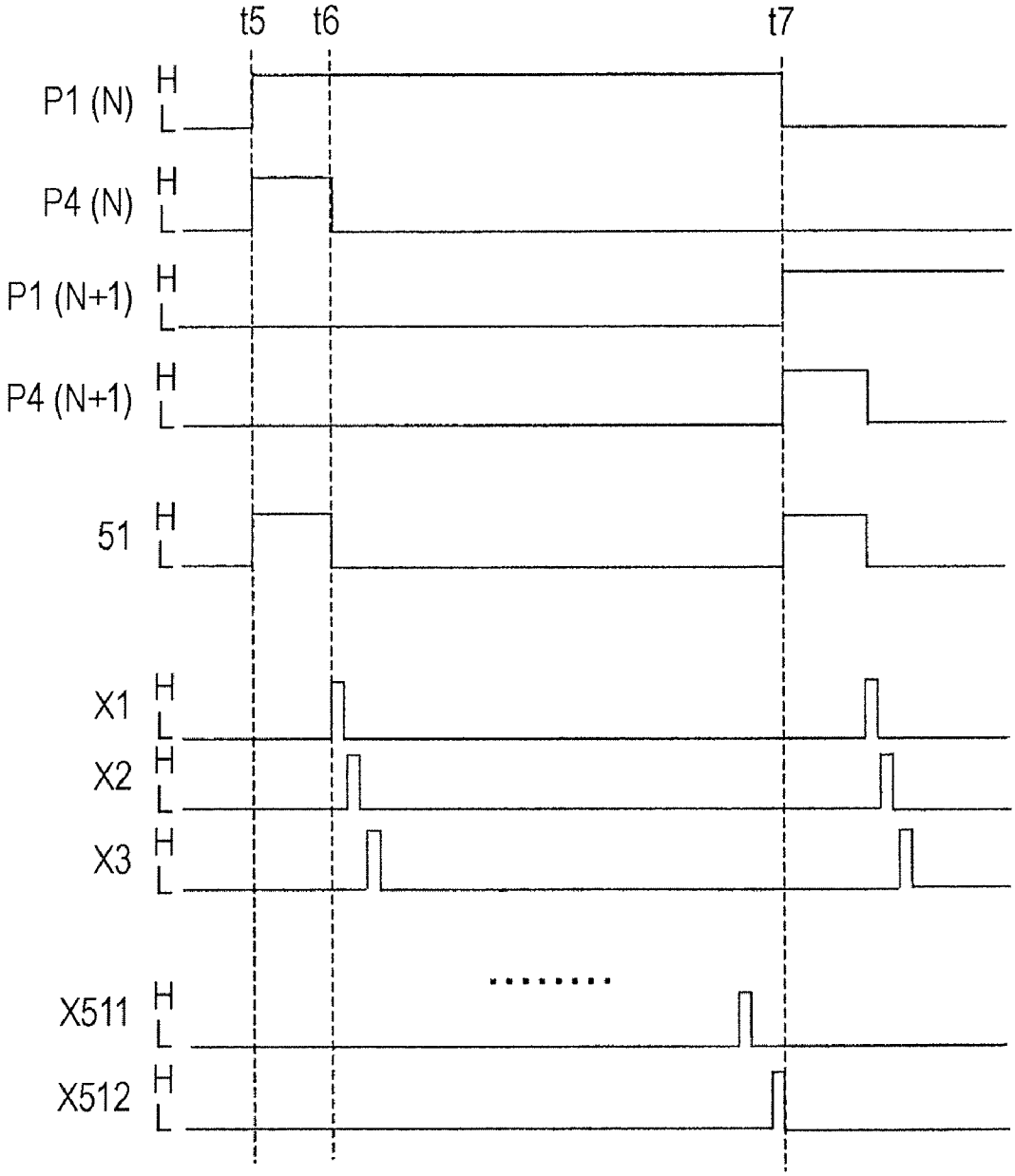
FIG. 4 is a timing chart illustrating other operations of the pixel circuits shown in FIG. 1A.

FIG. 4 is a timing chart illustrating the current-testing operation of the pixel circuits shown in FIG. 1A. Signals identical to those shown in FIG. 3 have the same reference numbers or symbols. In FIG. 4, a control signal of all the switches 51 has the same reference number 51. X1, X2, . . . denote signals on a control line 58 in terms of column. The number of columns preferably is 512. Before the current testing, the voltages of the first control line P1 and the second control line P4 in one row (the Nth row) are set to the H level at time t5 such that the Nth row is selected. At the same time, the switches 51 are turned on (closed) such that the display signals are supplied from the column-driving circuits 3 to the data lines 4. The display signals are predetermined signals indicating, for example, "white" images, so as to generate driving currents that are not zero. The voltages of all the control lines P1 and P4 in the other rows (P1(N+1), P4 (N+1), . . . , and the like) are maintained at the L level. Since the voltages of the control lines P1(N) and P4(N) are at the H level, the switches S1 and S2 of the pixel circuits 10 are turned on, and the third switches S3 are turned off. Therefore, the signals of the data lines 4 are input to the pixel circuits 10 in the Nth row. Next, at time t6, the voltage of the second control line P4(N) is lowered to the L level while the voltage of the first control line P1(N) is maintained at the H level. At the same time, the switches 51 disposed on the data lines 4 are turned off so as to cut off the connection between the column-driving circuits 3 and the data lines 4. The voltages of all the control lines P1 and P4 in the other rows (P1(N+1), P4 (N+1), . . . , and the like) are maintained at the L level. At this moment, the first switches S1 of the pixel circuits 10 in the Nth row are turned on, and the second switches S2 and the third switches S3 are turned off. Therefore, the drain terminals of the driving transistors M are connected to the data lines 4, and the currents passing between the sources and the drains of the driving transistors M flow out to the data lines 4 via the first switches S1. These currents serve as inputs to the current-detecting circuits 50. Current amplifiers acquiring the currents flowing out to the data lines 4 as inputs can be configured as the current-detecting circuits 50, although other types of current-detecting circuits also can be used. Alternatively, voltage-amplifying circuits into which voltages of capacitors Cx are input can be configured as the current-detecting circuits 50 since the capacitors Cx are disposed or parasitically generated on the data lines 4 and are charged by the current flowing out to the data lines 4. The current-detecting circuits 50 are column-sequentially selected using the signals X1, X2, . . . of the control line 58, and become active. With this, the current value of each column is detected in a chronological manner, and a voltage relative to the current value is output from the corresponding current-detecting circuit 50. After all the columns are selected, the (N+1)th row is selected at time t7 so as to perform the data acquisition and the current detection described above. The same operations are successively repeated in the (N+2)th row, the (N+3)th row, etc . . . . In this manner, the values of currents passing through the driving transistors M of all the pixel circuits are detected.

Current testing as described above preferably is performed after pixel circuits are formed on a substrate of an active-matrix device and before EL elements are provided for the pixel circuits so as to check and remove substrates including defective pixel circuits. This can lead to a higher production efficiency of the EL elements since the EL elements can be formed only on substrates that function normally. The current testing can be performed after the formation of the EL elements when the light emission of the EL elements is enabled. With this, it can be easily determined whether the light emission failure is caused by the pixel circuits or the EL elements. Moreover, the current testing can be performed in the intervals between display operations after the completion of the display apparatus. The characteristics of the TFTs constituting the pixel circuits change over time. In particular, the change in the characteristics is marked when the TFTs are formed of an organic semiconductor or an oxide semiconductor. Reductions in brightness can be compensated in units of pixels on the basis of the obtained current values by increasing the currents or voltages applied to the pixel circuits having brightness reduced due to the change in the characteristics. The intervals between display operations can be the periods between the time t2 and the time t3, or vertical blanking intervals (between frames). Alternatively, the current testing can be performed immediately after power-on or immediately before power-off of the display apparatus.

Function and Control of Pixel Circuit

Table 1 shows the functions of the pixel circuits described with reference to FIGS. 3 and 4 in terms of the voltage levels of the first control line P1 and the second control line P4.

TABLE 1

| | | P1 | |
|---|---|---|---|
| | | H | L |
| P4 | H | Programming | Non-light emission |
| | L | Current testing | Light emission |

As described above, the four functions, the programming in which the display signals are acquired and retained, the light emission in which currents or voltages corresponding to the display signals are supplied to the display elements, the current testing for examining the operations of the pixel circuits, and the non-light emission in which the light emission times of the EL elements are controlled, can be switched using the two control lines. Since only two control lines are required for switching these functions, display apparatuses with higher definition can be realized. Moreover, only small parasitic capacitances are generated at intersecting portions between the data lines and the control lines.

According to a preferred embodiment of the invention, the number of control lines can be regulated to two due to the second switches S2 and the third switches S3 each having two switching transistors connected in series. Both the first switches S1 and the second switches S2 are turned on during the programming, and are turned off during the light emission. These functions can be switched using only the first control lines P1. The third switches S3 are turned off when the switches S1 and S2 are turned on, and are turned on when the switches S1 and S2 are turned off. Therefore, the third switches S3 can be complementarily controlled in synchronization with the switches S1 and S2. More specifically, the first switches S1 and the third switches S3 preferably are formed of transistors having polarities opposite to each other. With this, the switches can be complementarily controlled using positive and negative logics on the first control lines P1. Moreover, the switches S1 and S2 (which can be opened or closed in the same manner) preferably are formed of transistors having the same polarity. As referred to herein, the "polarities" of transistors means those of majority charge carriers in the semiconductor. The polarities of PNP bipolar transistors and those of NPN bipolar transistors are opposite to each other. The polarities of P channels and N channels of metal-oxide semiconductor field-effect transistors (MOSFETs) are also opposite to each other. In order to switch between the light emission and non-light emission states, the third switches S3 need to be controlled while the switches S1 and S2 are turned off. To this end, each of the third switches S3 is configured to have two switching transistors S3*a* and S3*b* connected in series such that the switching transistors (herein S3*a*) that are complimentarily controlled in synchronization with the first switches S1 are controlled using the first control lines P1 and the other switching transistors (S3*b*) are controlled using the second control lines P4. On the other hand, the second switches S2 need to be turned on or off for switching between the programming and the current testing functions while the first switches S1 are turned on. However, the first switches S1 are turned on both during the programming and during the current testing, and the third switches S3 each including two switching transistors S3*a* and S3*b* connected in series are turned off since the switching transistors S3*a* controlled by the first control lines P1 are turned off. Thus, the switching transistors S3*b* controlled by the second control lines P4 can be either turned on or off. Therefore, the second control lines P4 can be used to control the second switches S2 during these periods. In order to switch between the programming and the current testing using the second control lines P4, each of the second switches S2 preferably is configured to have two switching transistors connected in series such that the switching transistor(s) (herein S2*a*) controlled in synchronization with the first switches S1 are controlled using the first control lines P1 and the other switching transistor(s) (S2*b*) are controlled using the second control lines P4. Both the switching transistors of each second switch S2 connected in series need to be turned on during the programming, and one of the switching transistors needs to be turned off during the current testing. However, as described above, the third switches S3 do not need to be controlled using the second control lines P4 during these operations. Therefore, the second control lines P4 can be used to control the second switches S2. In contrast, the third switches S3 are turned on or off using the second control lines P4 in order to switch between the light emission and the non-light emission states. Since the second switches S2 are turned off by the control using the first control lines P1 both during the light emission and during the non-light emission, the second switches S2 do not need to be controlled using the second control lines P4. Thus, the second control lines P4 can be used to control the third switches S3. In this manner, the switches S2 and S3 each including two switching transistors connected in series can switch between the programming and the current testing and between the light emission and the non-light emission, respectively, using the second control lines, and thus require no third control lines.

First Modification

Figure 5:
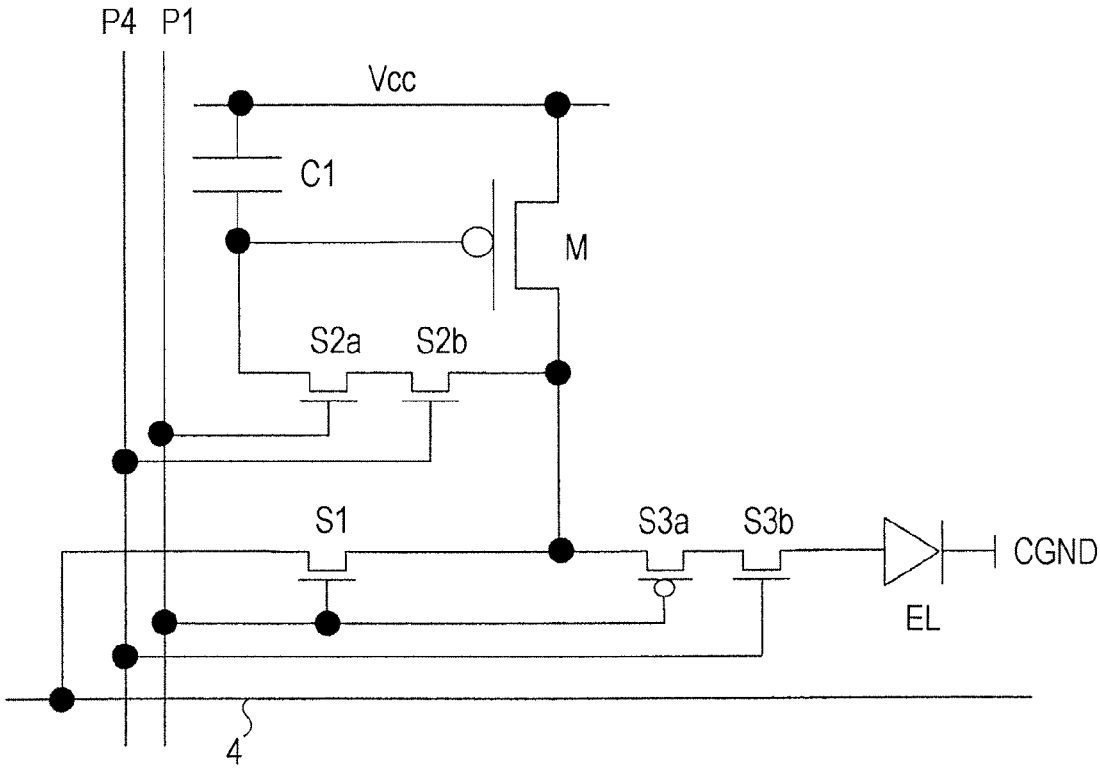
FIG. 5 illustrates a modification of the pixel circuits in the display device according to the exemplary embodiment of the present invention.

FIG. 5 illustrates a modification of the pixel circuits shown in FIG. 1A, according to another exemplary embodiment of the invention. The pixel circuit of FIG. 5 differs from those shown in FIG. 1A only in that both the switching transistors S2*b* and S3*b* controlled using the second control line P4, are N-channel TFTs having the same polarity. As described with reference to the circuits shown in FIG. 1A, the switching transistors S2*b* and S3*b* can be switched regardless of the switching states of each other. Therefore, the channel polarities of the TFTs can be the same such that the switching transistors are opened or closed in the same manner, or can be opposite to each other as shown in FIG. 1A such that the switching transistors are complementarily controlled. Table 2 shows the relationship between the voltages on the control lines and the four operations.

TABLE 2

| | | P1 | |
|---|---|---|---|
| | | H | L |
| P4 | H | Programming | Light emission |
| | L | Current testing | Non-light emission |

The light emission is performed when the voltages of the second control lines P4 are at the H level, and the non-light emission is performed when the voltages are at the L level unlike the circuits shown in FIG. 1A. The circuit shown in FIG. 5 preferably includes N-channel TFTs, which have less current leakage while both the switching transistors S3*a* and S3*b* of the third switches S3 are turned off, so as to more reliably block the currents as compared with the circuits shown in FIG. 1A.

Second Modification

Figure 6:
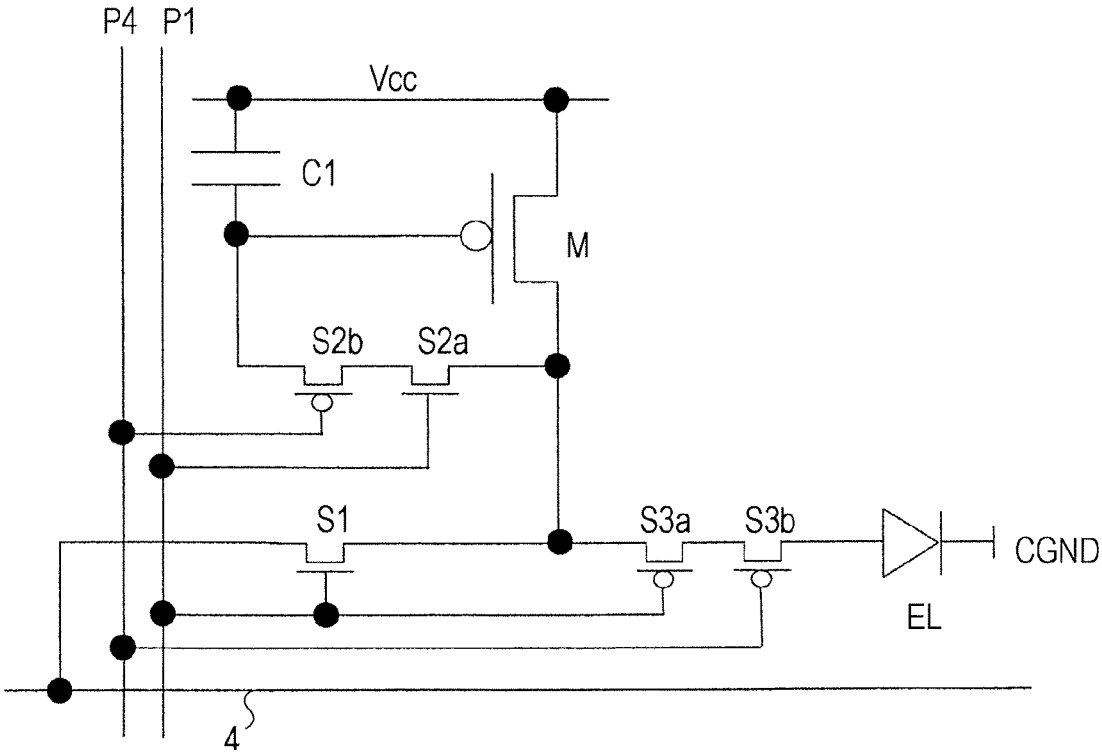
FIG. 6 illustrates another modification of the pixel circuits in the display device according to the exemplary embodiment of the present invention.

FIG. 6 illustrates another modification of the pixel circuits shown in FIG. 1A, according to another exemplary embodiment of the present invention. The pixel circuit of FIG. 6 differs from those shown in FIG. 1A only in that both the switching transistors S2*b* and S3*b* controlled using the second control line P4, are P-channel TFTs having the same polarity. Table 3 shows the relationship between the voltages on the control lines and the four operations.

TABLE 3

| | | P1 | |
|---|---|---|---|
| | | H | L |
| P4 | H | Current testing | Non-light emission |
| | L | Programming | Light emission |

The current testing is performed when the voltages of the second control lines P4 are at the H level, and the programming is performed when the voltages of lines P4 are at the L level unlike the circuits shown in FIG. 1A.

Structure of TFT

The driving transistors M and the switching transistors S3*a* and S3*b* constituting the circuits shown in FIG. 1A preferably are P-channel insulated-gate TFTs composed of non-monocrystalline silicon. On the other hand, the first switches S1 and the switching transistors S2*a* and S2*b* preferably are N-channel insulated-gate TFTs composed of non-monocrystalline silicon.

Figure 7:
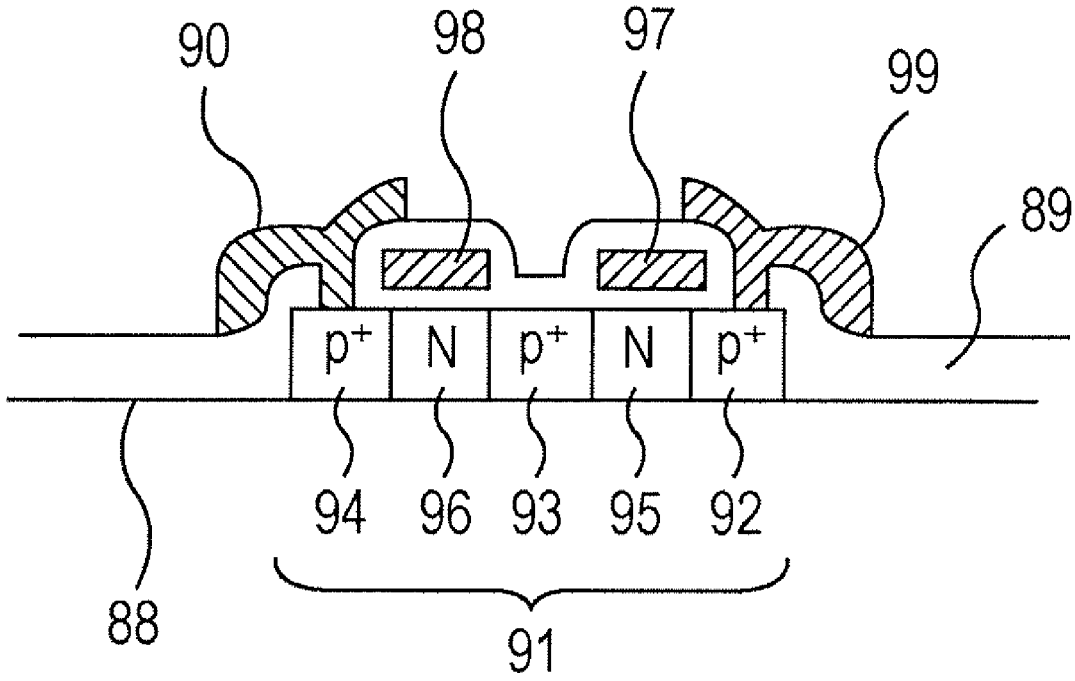
FIG. 7 is a schematic cross-sectional view of a TFT used in the display device according to the exemplary embodiment of the present invention.

FIG. 7 is a schematic cross-sectional view of a TFT used for the switches, according to an exemplary embodiment of the invention.

The TFT includes a substrate 88 composed of glass and the like having an insulating surface, an insulating layer 89, and a source or drain electrode 90 connected to, for example, the drain of a driving transistor M (not shown in FIG. 7). Islands 91 of a thin-film semiconductor such as polycrystalline silicon include source or drain regions 92, 93, and 94 composed of a $P^+$-type semiconductor and channel regions 95 and 96 composed of an N-type semiconductor. The TFT further includes gate electrodes 97 and 98, and a source or drain electrode 99 connected to the anode of a light-emitting element EL (not shown in FIG. 7).

The switching transistors S3*a* and S3*b* can share the $P^+$-type semiconductor region 93 as a common connection node. That is, the switching transistors S3*a* and S3*b* can be formed in a common island of a non-monocrystalline thin-film semiconductor. Since two transistors having the same conductivity type can be formed in a common island, a contact region connected to the source or drain electrode can be omitted.

Similarly, the switching transistors S2*a* and S2*b* can share one of the N-type semiconductor regions as a common connection node. That is, the switching transistors S2*a* and S2*b* can be formed in a common island of a non-monocrystalline thin-film semiconductor. In this case, the conductivity types of the semiconductor regions shown in FIG. 7 are reversed.

According to exemplary embodiments of the present invention, the transistors can be of a lightly doped drain (LDD) structure including the drains with doped regions adjacent to the gate electrodes and with highly doped regions whose dopant density is higher than that in the doped regions, although other types of suitable structures also can be used.

According to exemplary embodiments of the present invention, the display elements can include, for example, organic EL elements, inorganic EL elements, electron-emitting elements, those including a combination of electron-emitting elements and fluorescent members, and electro-optical elements such as light-emitting diodes, although other types of display elements also can be used.

Moreover, according to exemplary embodiments of the present invention, the transistors include, for example, TFTs having active layers composed of a non-monocrystalline semiconductor such as amorphous silicon, polycrystalline silicon, and microcrystalline silicon, although in other embodiments other suitable types of transistors can be used. Moreover, the present invention can be applied to pixel circuits in, for example, active-matrix devices using a compound semiconductor, an oxide semiconductor, or an organic compound semiconductor other than silicon, or in other matrix devices as well.

EXAMPLE

Figure 8:
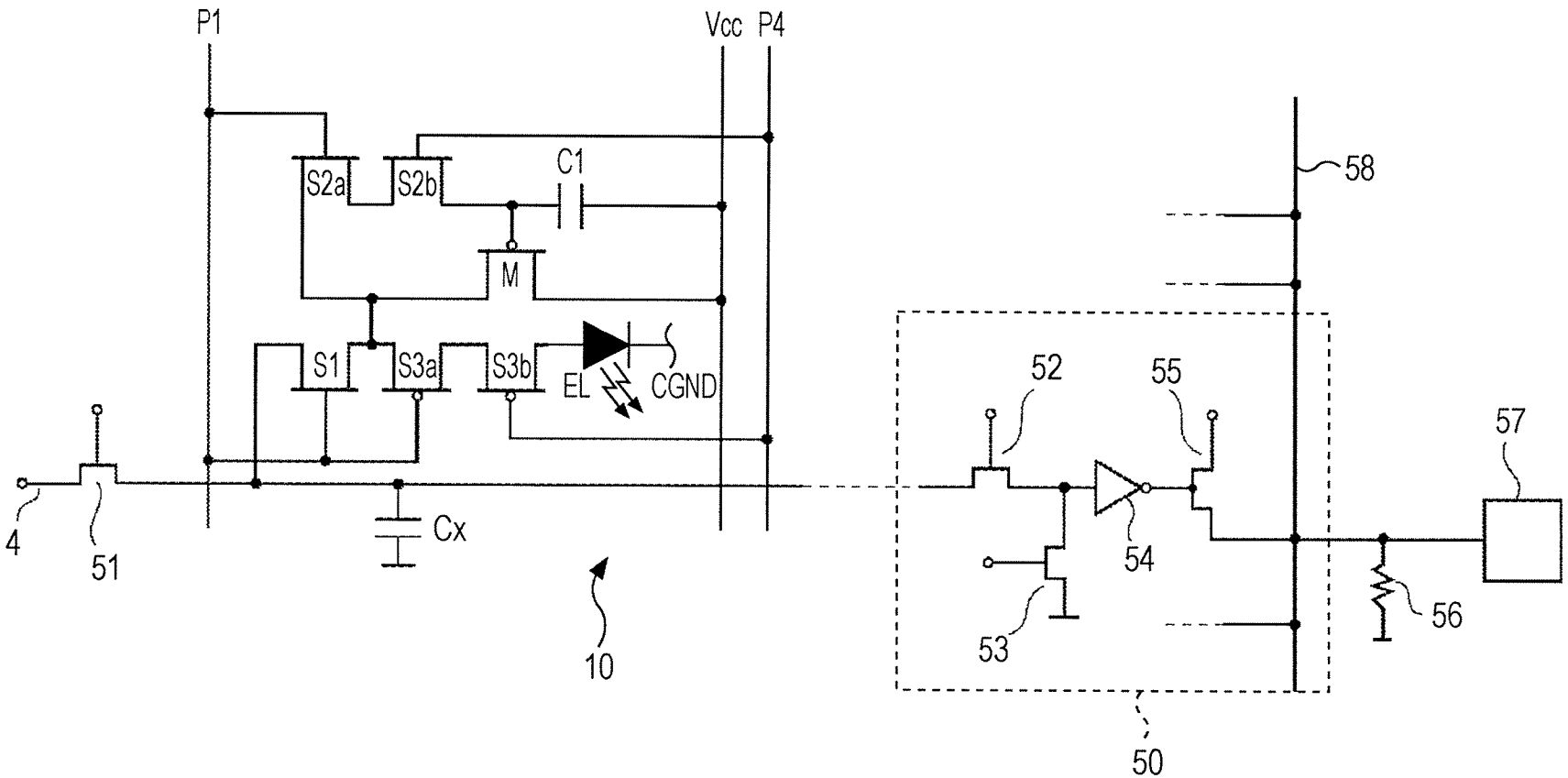
FIG. 8 illustrates a pixel circuit and a current-detecting circuit used in a display device according to an example of the present invention.

The current-detecting circuits 50 shown in FIG. 1A can receive currents or voltages supplied via the data lines 4 and can output currents or voltages according to the values of the supplied currents or voltages. FIG. 8 illustrates a display device including an exemplary current-detecting circuit 50 and pixel circuit of FIG. 1A according to an example of the present invention (only one of each such circuit is shown, for convenience). The current-detecting circuit 50 shown in FIG. 8 includes switches 52 and 53 formed of N-channel transistors, a CMOS inverter 54, and a P-channel transistor 55. These components are disposed on the same substrate as the pixel circuit 10. The output portion of the current-detecting circuit 50 is connected together to a load resistor 56 and a measuring circuit 57 disposed outside the display panel. The load resistor 56 and the measuring circuit 57 are disposed outside the substrate having the display device formed thereon. Switches 52 of circuit 50 are successively selected in terms of column (on a column-by-column basis) using a respective control line 58 shown in FIG. 1A (not shown in FIG. 8) so as to activate the respective current-detecting circuits 50 to a measurable state. When the current-detecting circuit 50 in one column is active, the output impedances of the other current-detecting circuits 50 in the other columns are at a high value. Therefore, the output of the active current-detecting circuit 50 is measured using the load resistor 56 and the measuring circuit 57, which are common to all, or otherwise provided for each of the columns, and the results are stored in a memory (not shown). When the Nth row is selected and the drains of the driving transistors M in the pixel circuits 10 are connected to the data lines 4, the switch 52 in one column is turned on. Gate-control signals for turning on the switches 52 are successively applied sequentially on a column-by-column basis. Next, the corresponding switch 53 is momentarily turned on so as to reset the potential of the corresponding data line 4 to the ground level, and then is turned off. This operation can be performed on all the columns since the switches 52 in the other columns are turned off and no effects are exerted on the potentials of the other data lines. After the switch 53 is turned off, the potential of the data line 4 is increased since a current is supplied from the driving transistor M in the pixel circuit 10 in the selected Nth row to a parasitic capacitor Cx on the data line 4. When the potential of the data line 4 exceeds a reversing threshold level of the CMOS inverter 54, the output of the CMOS inverter 54 is reversed from the H level to the L level. When the output of the CMOS inverter 54 is reversed, the P-channel transistor 55 supplies a current to the load resistor 56. With this, the voltage across the ends of the load resistor 56 becomes the H level. The measuring circuit 57 includes a counter (not shown), and counts the time elapsed since the switch 53 of the current-detecting circuit 50 is momentarily turned on. The counter stops counting when the input voltage to the measuring circuit 57 exceeds a certain value, and a time T since the switch 53 was turned off until the voltage of the load resistor 56 reached the H level is determined on the basis of the value. When the threshold voltage of the CMOS inverter 54 is defined as Vth, the measured time T and the current I passing through the driving transistor M have the following relationship:

$$I=Cx\cdot Vth/T$$

When the time T is smaller than a predetermined value, it is determined that an excessive current is passing through the driving transistor M. When the time T is larger than the predetermined value, it is determined that the current passing through the driving transistor M is insufficient. In this manner, it can be determined whether a predetermined current is passing through the driving transistor M on the basis of the measured time T. During this measurement, the potentials of the current-detecting circuits 50 in the other columns are maintained at the ground level by the momentary turn-ons of the switches 53 since the switches 52 in the other columns are open. The outputs of the CMOS inverters 54 are not reversed, and the output impedances of the P-channel transistors 55 are kept high, i.e., the P-channel transistors 55 are kept turned off. Therefore, only the output from the current-detecting circuit 50 in the selected column is supplied to the output line common to all the current-detecting circuits, and measured by the measuring circuit 57.

The above-described measurement is performed sequentially on a column-by-column basis until all columns of the row have been completed, and then the same is repeated in the next row. In this manner, currents passing through the driving transistors M in all the pixel circuits are examined.

While the present invention has been described with reference to exemplary embodiments, it is to be understood that the invention is not limited to the disclosed exemplary embodiments. The scope of the following claims is to be accorded the broadest reasonable interpretation so as to encompass all modifications, equivalent structures and functions.

This application claims the priority of Japanese Application No. 2006-097996 filed Mar. 31, 2006, which is hereby incorporated by reference herein in its entirety.

What is claimed is:

1. A display device comprising:

a matrix that includes a plurality of rows and columns of pixels, each pixel including a display element and a driving circuit arranged to drive the display element;

a plurality of pairs of control lines, each pair being associated with a row of the pixels and including a first control line and a second control line; and a plurality of data lines, each data line being associated with a column of the pixels, the driving circuit of each pixel comprises:

a driving transistor including at least first and second main electrodes and a control electrode, a first switch to close or open a connection between the first main electrode of the driving transistor and the corresponding data line, a second switch to close or open a connection between the first main electrode of the driving transistor to the control electrode, the second switch including first and second switching elements connected in series, and a third switch to close or open a connection between the first main electrode of the driving transistor to the display element of the pixel, the third switch including third and fourth switching elements connected in series, wherein the first control line associated with the row of the pixel is arranged to control the first switch, the first switching element of the second switch and the third switching element of the third switch such that the first switch and the first switching element of the second switch are opened or closed simultaneously and the first switching element of the second switch and the third switching element of the third switch are opened or closed complementarily, and, the second control line associated with the row of the pixel is arranged to control the second switching element of the second switch and the fourth switching element of the third switch.

2. The display device according to claim 1, wherein the first and second control lines control the first switch and the first and second switching elements of the second switch to close and the third switching elements of the third switch to open to perform a current data programming operation in which a driving current signal supplied on the data line associated with the column of the pixel is provided through the first and second main electrodes of the driving transistor and a voltage corresponding to the driving current signal is stored in a storage device.

3. The display device according to claim 2, wherein the first and second control lines control the first switch and the first switching elements of the second switch to open and the third and fourth switching elements of the third switch to close to perform a light emitting operation in which a driving current is supplied to the display element to cause it to emit light.

4. The display device according to claim 3, wherein the first and second control lines control the first switch and the first switching elements of the second switch to open and the fourth switching elements of the third switch to open to perform the non-light emitting operation in which no driving current drives the display element, and so that the display element does not emit light.

5. The display device according to claim 4, wherein the first and second control lines control the first switch to close and the second switching elements of the second switch and the third switching elements of the third switch to open to perform the pixel current testing operation in which a current signal passes across the first and second main electrodes of the driving transistor towards a current measuring device.

6. The display device according to claim 5, wherein the current measuring device detects a current of the signal.

7. The display device according to claim 5, wherein the current measuring device is electrically coupled to each data line to measure a current thereon.

8. The display device according to claim 7, wherein the current is measured for columns in sequence.

9. The display device according to claim 1, wherein the first, second, and third switches are formed of thin-film transistors, the first switching element of the second switch and the third switching element of the third switch have opposite channel polarities to each other.

* * * * *